US006186857B1

(12) United States Patent
Gazit et al.

(10) Patent No.: US 6,186,857 B1
(45) Date of Patent: Feb. 13, 2001

(54) APPARATUS AND METHOD FOR PROVIDING INFLATED UNDULATING FIGURES

(76) Inventors: Doron Gazit, 3636 Military Ave., Los Angeles, CA (US) 90034; Arieh Leon Dranger, 6427 San Vicente Blvd., Los Angeles, CA (US) 90048

( * ) Notice: Under 35 U.S.C. 154(b), the term of this patent shall be extended for 0 days.

(21) Appl. No.: 09/225,787

(22) Filed: Jan. 5, 1999

Related U.S. Application Data

(63) Continuation-in-part of application No. PCT/US97/12929, filed on Jul. 3, 1997.
(60) Provisional application No. 60/021,671, filed on Jul. 5, 1996.

(51) Int. Cl.[7] ..... G09F 19/08; A63H 3/06
(52) U.S. Cl. ..... 446/226; 446/176; 446/178; 446/179; 446/199; 40/406; 40/412; 40/439
(58) Field of Search ..... 446/176, 178, 446/179, 199, 201, 205, 210, 220, 226; D10/19; 40/406, 412, 439

(56) References Cited

U.S. PATENT DOCUMENTS 3,346,978 * 10/1967 Letsinger .
5,186,675 * 2/1993 Stoddard ..... 446/199
5,467,543 * 11/1995 Fink et al. ..... 40/538

OTHER PUBLICATIONS

Brochure entitled "Vertitubes".

* cited by examiner

*Primary Examiner*—Jacob K. Ackun
*Assistant Examiner*—Kevin Hughes
(74) *Attorney, Agent, or Firm*—Ashen & Lippman

(57) ABSTRACT

Apparatus and method for providing a dynamic gas-inflated object such as a figure with legs, a torso and head, and a pair of arms. The figure performs generally repetitive movements such as dance-like undulations in a manner that appears to keep time with music. The figure is hollow and connected to a continuous generally constant input flow of air or other gas under pressure. The figure is provided with at least two spaced-apart outlets or vents to allow a continuous discharge of generally all of the air being introduced into the figure. In operation, the figure tends to cycle between extending generally upright, then, as more air is discharged, destabilizing and moving to a contorted or bent position, then, as more air flows in, to extending, etc. The figure may be designed for extensive movement e.g., dancing, or for a narrower range of movements. In a preferred form, the outlets are generally at the top of the head and at the ends of the arms. The dynamic figure movement is a result of the continuous generally constant input gas flow and does not depend upon any intentional intervention.

33 Claims, 8 Drawing Sheets

FIG. 2
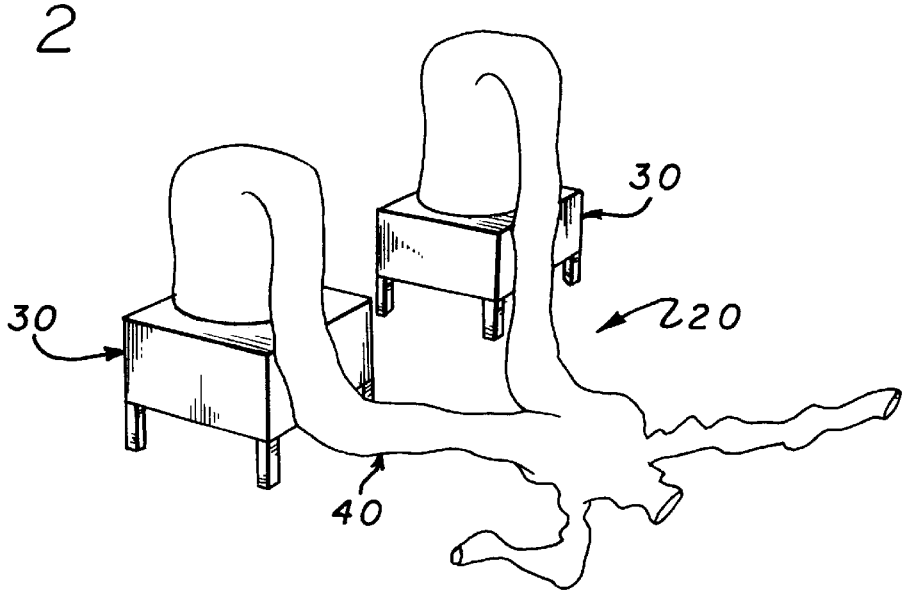
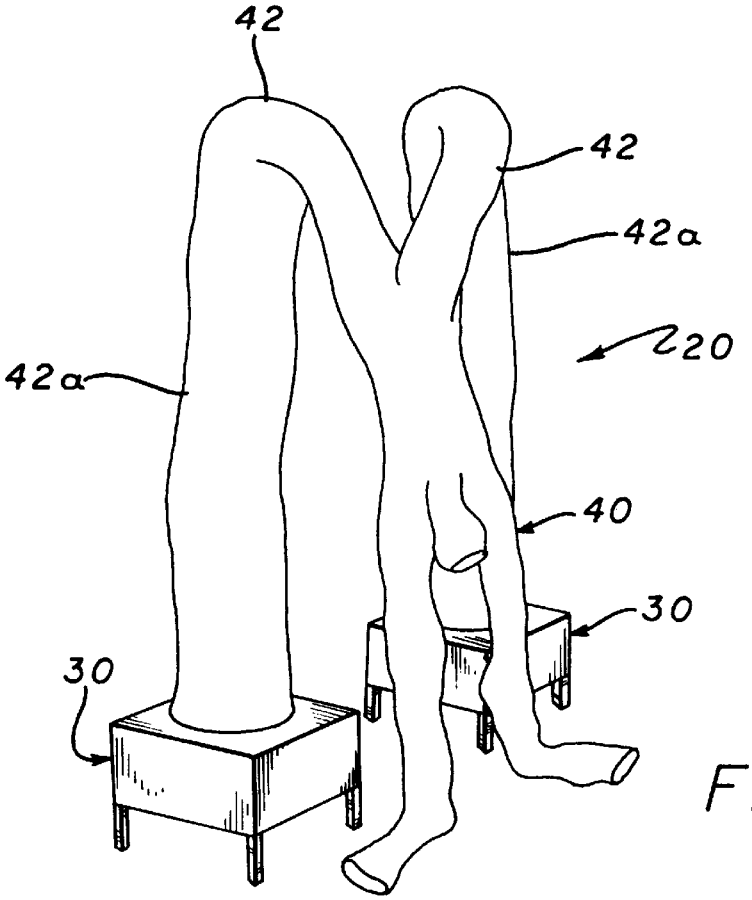
FIG. 3

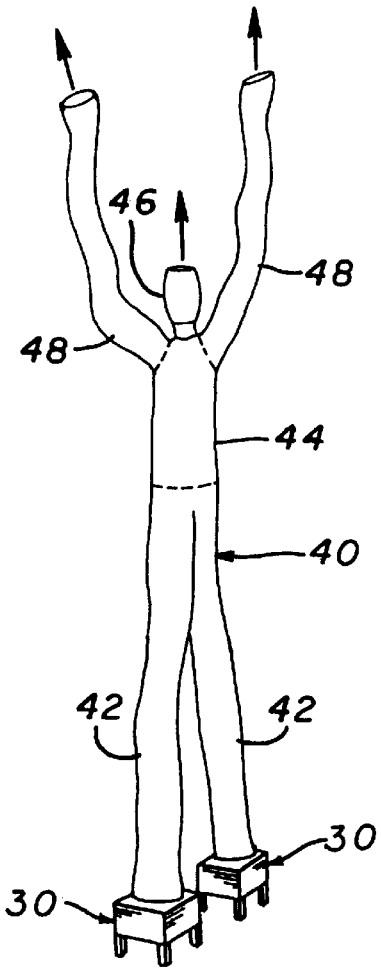
FIG. 6A
FIG. 6B
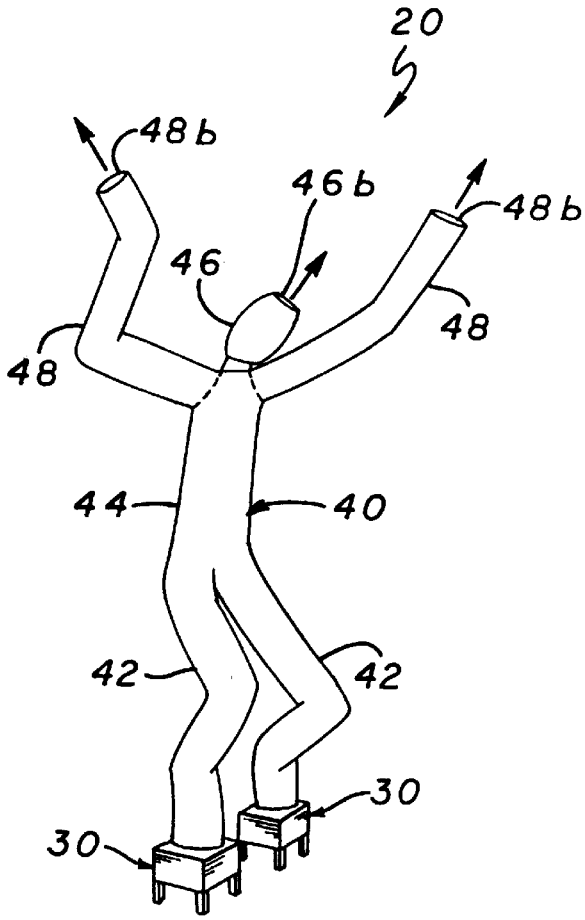
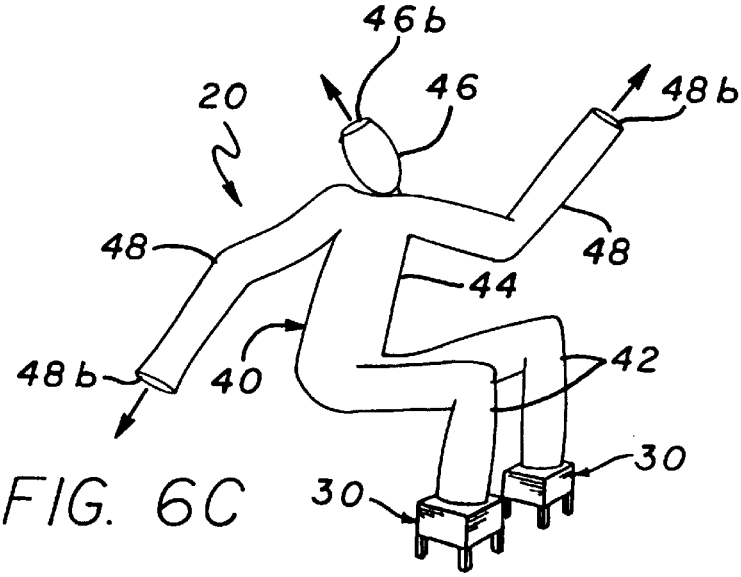
FIG. 6C

FIG. 6D
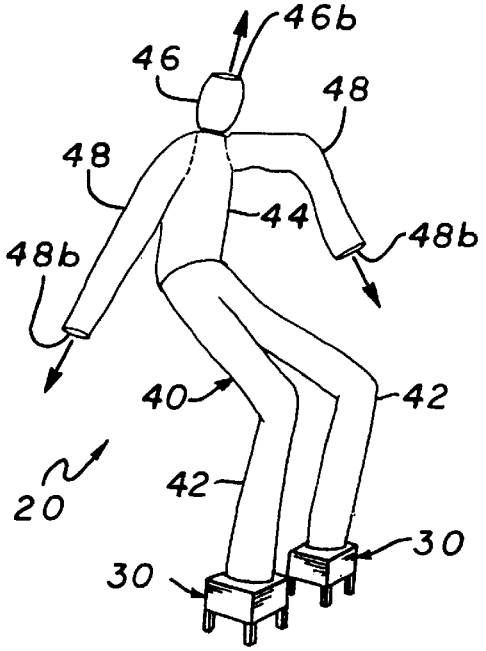
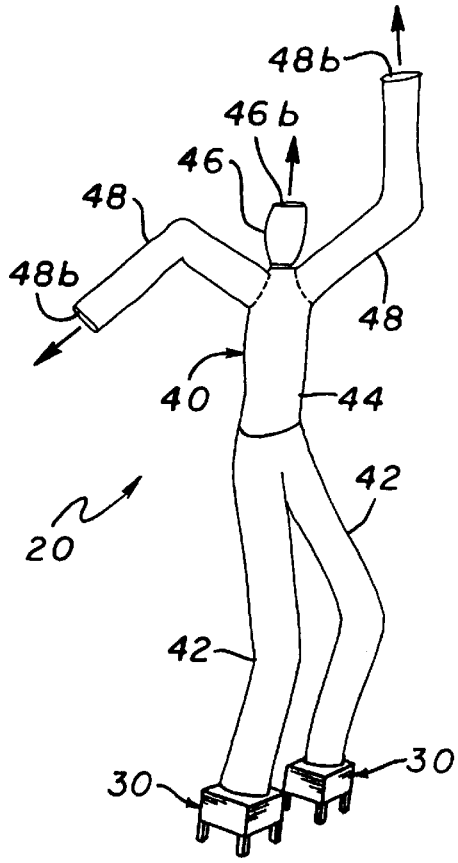
FIG. 6E
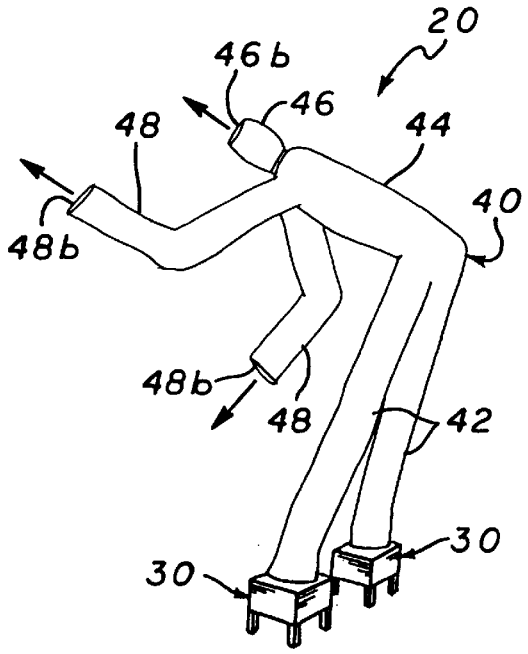
FIG. 6F

FIG. 9
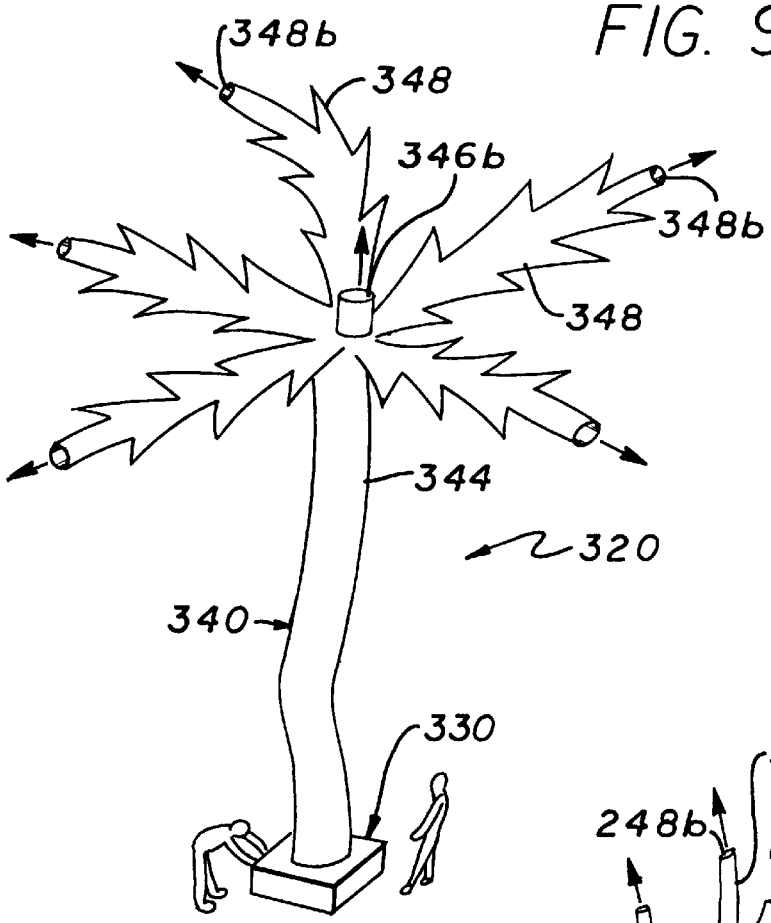
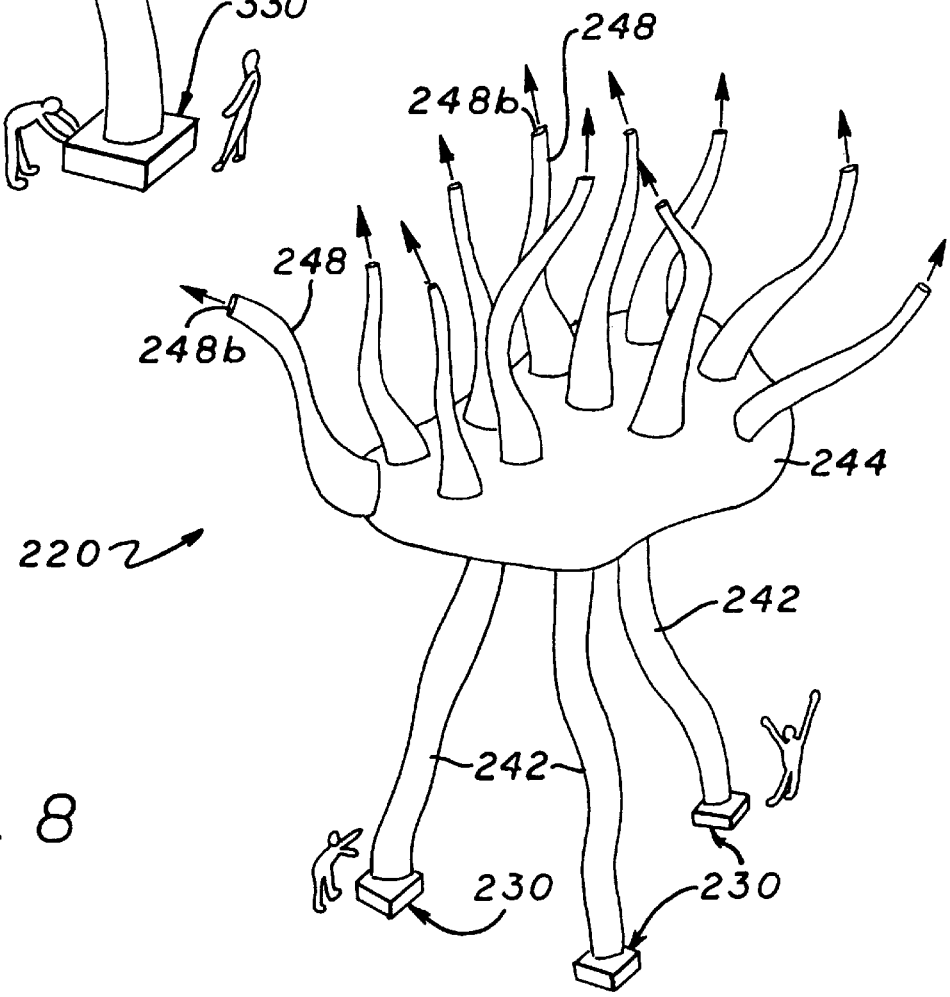
FIG. 8

APPARATUS AND METHOD FOR PROVIDING INFLATED UNDULATING FIGURES

RELATED APPLICATIONS

This application is a Continuation-in-Part of prior U.S. Provisional Patent Application No. 60/021,671 filed on Jul. 5, 1996, and of prior PCT Application No. PCT/US97/12929, filed on Jul. 3, 1997, and claims the benefit of said prior applications.

FIELD OF THE INVENTION

Dynamically inflatable decorative devices which provide their own cyclical movement.

BACKGROUND OF THE INVENTION

There is a long history of the use of inflatable objects, particularly in the form of static figures to provide visual displays. Often such figures depicted human, animal or humanoid characters that might be utilized at openings or events or at places such as amusement parks. Such inflatable figures provided an easy and economical way to provide relatively large figures which could be deflated for easy shipment and storage.

Such figures might be mounted or supported in such a way that desired movement might be imparted to the figure as for example by attached guide wires or by fan-produced transverse wind currents. They did not have the inherent ability within themselves to provide movement.

Similarly, applicant and others have provided large decorative displays in the form of arrays or inflatable colored tubing arranged and supported in a variety of configurations on buildings or similar large structures.

One relatively recent development has been a product known as the "Vertitube" which essentially comprises a single upright inflatable tube which is secured at its lower end to an air blower or pump. The tube is open at its upper end so that air pumped in to the lower end is discharged through the open upper end. In operation, as the tube inflates and extends upwardly, various destabilizing forces act on the tube, including forces of gravity, shifts in dynamic and static pressure produced by the air flow into and out of the tube, external wind currents, etc. These combined forces tend to cause the upwardly extended tube to bend or deform temporarily. Such deformation, and the resultant increase in internal static pressure, primarily in the upward direction, tend to return the tube to its upright extended position, where it is again subject to the destabilizing forces. Such tubes tend to provide random or apparently random cycling movement between the extended position and a destabilized bent or deformed position. Because of the simple structure of this tube the cycle of movement tends to be generally simple and repetitive, and therefore of somewhat limited variety and interest.

U.S. Pat. No. 5,186,675 to STODDARD discloses an inflatable balloon mountable over an air vent and operable to (I) be inflated by air from the vent, and (II) to collapse when air from the vent stops. It depicts, in its main embodiment, an inflatable ghost figure with a body, a head, and a pair of arms that extend generally outwardly to the sides. There are a series of small "exhaust ports 18" that are disposed along the underside of each arm 14. The primary stated function of these small ports is to "direct air flow over streamers 17 to cause them to move" (column 4 lines 30–31). This reference patent also refers to the ports allowing "a portion of the entering air in the balloon to escape causing the balloon to shimmer and move" (claim 2 and Column 2, line 17). This prior art reference does not teach creating continuous and automatic repetitive bending and unbending of the figure in response to a continuous flow of gas into and out of the figure without intentional intervention. As noted above there is intentional intervention, i.e., turning the gas flow on and off so that it is not continuous. Even while the flow is on, there is only a "partial" release through the ports and no resultant bending.

U.S. Pat. No. 2,348,250 to GARDNER shows a an animated inflatable display figure that is made to move by intentionally changing the air pressure in the figure through a cam and valve arrangement.

U.S. Pat. No. 3,346,978 to LETSINGER shows an inflatable advertising device which is "air supported", i.e., intended to inflate and stay up. The inflated device has a small opening at the top for emission of colored "smoke" and to allow lamp heat to be dissipated. Thus, this reference does not disclose an inflatable object that moves as by extending and bending, and does not teach the use of a central opening or openings to implement or contribute to such movement.

SUMMARY OF THE ILLUSTRATED APPARATUS AND METHOD

In the presently preferred illustrated form, the apparatus includes an inflatable bendable figure that, in response to a continuous generally constant input flow of gas in a generally outward direction into the figure and without intentional intervention, inflates to a generally outwardly extended position and that automatically and continuously performs a generally repetitive cycle of movements between the extended position and at least one bent position.

As used in this application a "generally constant input flow of gas" means that there is an input source that provides a gas flow that is generally fixed or constant in terms of what the source itself provides to the object or figure, without regard to how that flow may be altered by the interaction of the flow with the object. For example, as described in detail below, the structure of the figure cooperates with the flow so that periodically a shift between static and dynamic pressure in the expanded figure allows the figure to bend, which results in a buildup of static pressure that temporarily reduces flow through the figure.

As used in this application, flow "without intentional intervention" means without action by the user or any control mechanism aside from the direct response of the apparatus to the flow. There is no change made by the user or a control mechanism to the flow into or out of the figure, as distinguished from any change in flow through the figure which results from the interaction between flow and figure such as just described above. The volume, pressure, etc. of input flow into or out of the figure is not changed or adjusted as by a valves or other means manually controlled by the operator or automatically controlled as by a timer or sensing control mechanism. There are no mechanical or physical members, lines, etc. attached to the figure to alter its movement. Unintentional forces such as a wind may impact figure movement, but that is not intentional intervention. In other words, the flow is introduced into the figure, and the operator and the apparatus, in effect, stand back and let the flow and figure simply interact and produce figure movement as they will.

The illustrated figure has a pair spaced apart legs, a torso, a head and a pair of outwardly and upwardly extending arms. Vents or outlets are provided at a plurality of spaced apart locations, preferably at the top of the head and at the ends of the arms, allowing for the continuous release of generally all of the gas being introduced into the figure. The outlets not only provide the outflow from the inflated figure, but the configuration and location of the outlets determines the magnitude and direction of reactive destabilizing forces produced by outflow from the outlets. This helps define and determine the particular movement pattern for the undulating inflated figure. Thus, the multiplicity of outlet vents, their locations, and the addition of ancillary sections of the figure provided by the arms produces a much more complex and sophisticated pattern of movement of the figure.

Preferably, the outlets provide a release of gas generally symmetrically with reference to the torso central axis. While it is desirable to have this symmetrical release of gas, the ancillary sections need not be symmetrical to achieve this result. For example, a figure might have one arm on one side with one large outlet and a plurality of arms on the other side with a plurality of small outlets.

For many applications, the extended object will be generally upright. This arrangement is simple and effective. On some occasions however, it may be desired that the object extend at an incline from the vertical. This could be done for visual aesthetic purposes or might simply be the convenient result of using the apparatus on an inclined surface such as a hillside.

Music may be provided to create the impression that the figure is dancing to the music. While the movement of the figure is random or apparently random, normally the illusion is nevertheless created that the figure is in fact dancing in the rhythm to the music. Similarly lighting, particularly intermittent or strobe type lighting, may also be provided to enhance the overall effect.

In the preferred form of illustrated apparatus and method, a pair of fans are provided, each connected to the lower end of one of the legs of the figure. The fans provide a generally constant or fixed input airflow, which may be adjustable to different constant flow levels to accommodate different figures and different environmental conditions such as ambient wind.

Alternately, a single fan may be provided with a bifurcated outflow, with each outflow going to one of the legs. Similarly the figure might be provided with a single structural leg connected to a single fan.

IN THE DRAWINGS

FIG. 2 is a schematic perspective view of the apparatus of FIG. 1 in it's fully deflated condition with the fans off.

FIGS. 3, 4, 5 and 6A are a series of schematic perspective views of the apparatus of FIG. 1 in a progressively further inflated conditions.

FIGS. 6B through 6F are a series of schematic perspective views of the apparatus of FIG. 1 illustrating a typical series of movements by the inflated figure.

FIG. 8 is another modified embodiment having three legs and a large number of ancillary sections.

FIG. 9 is a still further modified embodiment of the invention depicting a palm tree.

DETAILED DESCRIPTION OF THE DRAWINGS

Figure 1:
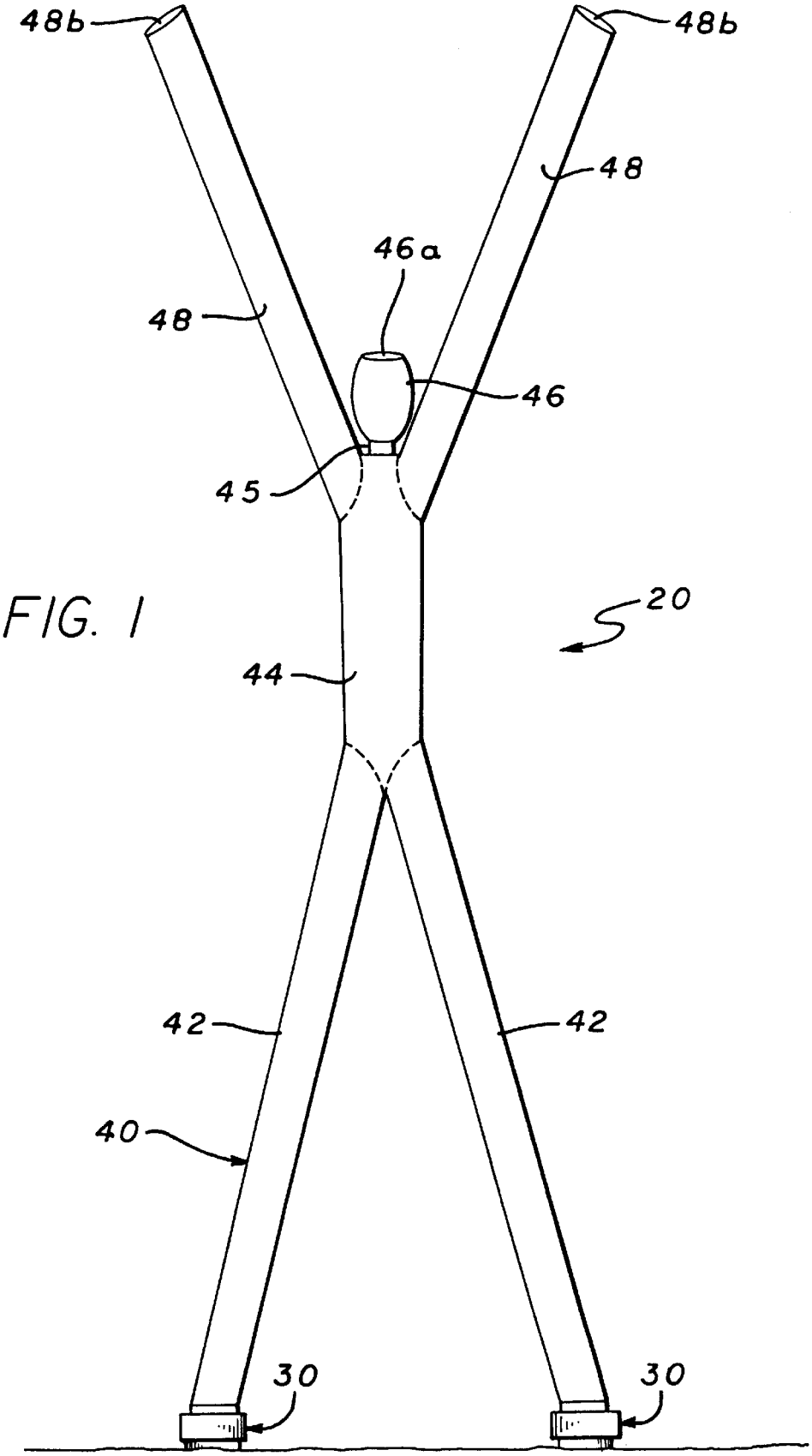
FIG. 1 is a schematic front view of an apparatus that embodies a presently preferred form of the invention and incorporates a gas-inflated object.

FIGS. 1–6 illustrate a presently preferred embodiment 20 of the present invention As noted above, in general, the illustrated apparatus 20 includes a pair of fans 30 and an inflatable bendable figure 40 that includes a spaced apart pair of leg sections 42, a torso section 44, a head section 46, and a pair of arm sections 48. All of the figure sections are in fluid communication with one another. The figure 40 is desirably made from an ultra-light, thin, generally non-porous, non-expandable tear-resistant fabric or sheet material that is sewn or otherwise formed into tubular sections that are connected together to form the full figure.

FIG. 1 shows the figure 40 in a hypothetical fully-extended fully-inflated condition wherein each of the leg sections 42 extends upwardly and inwardly from one of the fans 30, to where the leg sections join the lower end of the torso section 44. The torso section 44 then extends upwardly to where it joins with the lower end of a neck section 45. The upper end of the neck section 45 connects to the lower end of a head section 46. The torso section 44 also connects to the lower inward ends of the arm sections 48. The head section 46 extends upwardly, with the arm sections 48 extending upwardly and outwardly in either direction in a generally symmetrical manner. The lower ends of the leg sections 42 are connected to and in fluid communication with the air fans 30, which are spaced-apart a substantial distance to provide stability to the inflated figure 40.

The illustrated head section 46 is open to the ambient atmosphere at its upper end to provide an air vent or outlet 46*a*. Each of the arm sections 48 is also open to the ambient atmosphere at its outer end to provide an air vent 48*b*.

It will be noted that to provide an extensive or wide range of movement, the arm sections 48 and leg sections 42 of the figure 40 can be designed so that they are longer and out of proportion to the length of the torso section 44 when compared to the normal proportioning of a human torso. If such extensive or exaggerated movement of the figure 40 is desired, such proportioning will produce exaggerated bending and movement of the arm and leg sections. The arrangement and proportioning of the elements of the figures could be modified to vary the range of movements, as for example to produce a lesser range of movements.

DESCRIPTION OF A WORKING PROTOTYPE MODEL

Following is a detailed description of a typical working prototype model which embodies the preferred form of the apparatus and method, and which has performed satisfactorily.

A pair of high capacity commercial exhaust air fans: The details to the fan are determined by the size and shape of the dynamic figure. For the configuration of the figure described below, fans with the following specifications operated successfully:

Blade Diameter: 24"

Air Delivery: +/−7,000 CFM with free air

RPM: 1,750

HP: ¾

Voltage: 100 A.C.

Figure 1A:
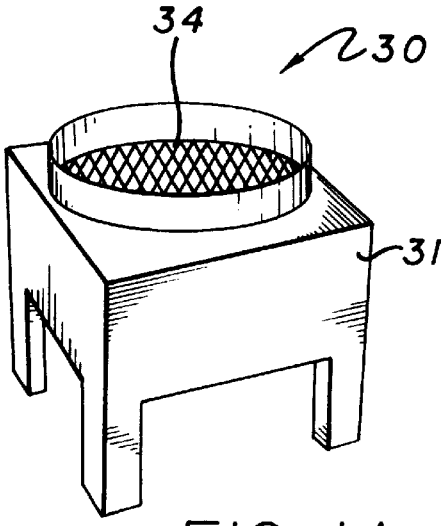
FIG. 1A is a schematic perspective view of a typical fan of the apparatus of FIG. 1 mounted in a support box.

The illustrated fans 30 are each mounted in a support housing or casing 31 such as shown in FIG. 1A with the fan outlet 34 facing upwardly. In the prototype, each fan had the following general dimensions:

| | ABOUT |
|---|---|
| Height: | 33" |
| Width: | 29" |
| Depth: | 29" |
| Clearance from ground: | 14" |
| Air outlet: | 26" |
| Spoiler: | 6" |

Figure 1B:
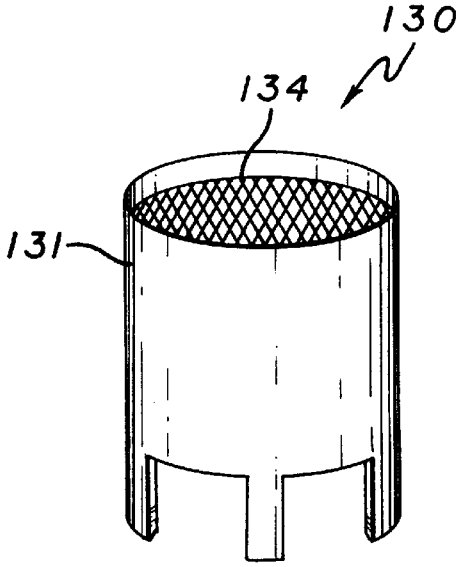
FIG. 1B is a schematic perspective view of a modified form of fan having a barrel-shaped housing.
Figure 1C:
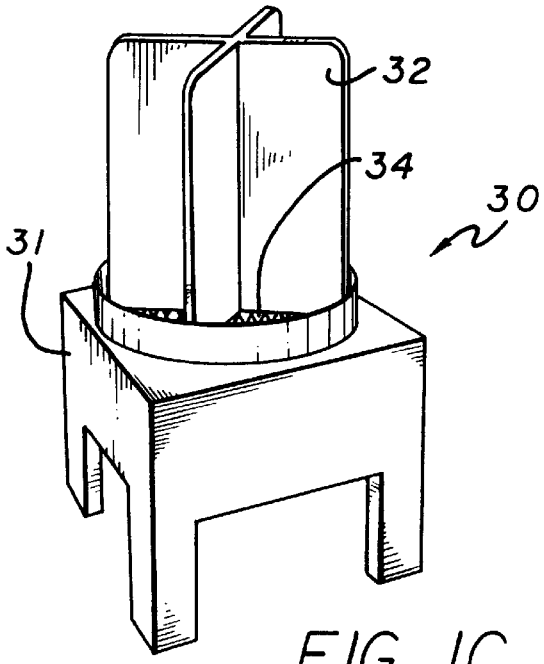
FIG. 1C is a schematic perspective view of the fan and support box of FIG. 1A with a tall set of spoilers mounted at the fan outlet.

In order to reduce undesirable turbulent air flow, a multi-section spoiler 32 may be mounted at the outlet 34 of each of the fans 30 as shown in FIG. 1C. The spoiler may be omitted if desired.

The prototype figure with the following specifications performed satisfactorily:

Fabric:

Ultra-light nylon or polyester

Typical weight is between about 0.5 to about 1.5 oz per square-yard

Strong rip-stop Near zero porosity, water repellent finish Dimensional Characteristics of figure: Very good overall movement and stability was achieved with the following approximate dimensions for a figure having a height of about 60 feet and receiving a combined total air flow of about 14,000 CFM, generated by both fans:

| | Approximate Diameter (Inches) | Approximate Length (Inches) (Feet) | Approximate Cross Section (Square-inches) |
|---|---|---|---|
| Leg section: | 24.00" | 312.00" (26') | 904.32 Sq-in (Both) |
| Torso section: | 32.00" | 120.00" (10') | 803.84 Sq-in |
| Arm section | 18.00" (outlet) | 264.00" (22') | 508.68 Sq-in (Both) |
| Head section: | | 33.00" (2.75') | |
| Top: | 16.00" (outlet) | | 200.96 Sq-in |
| Middle: | 25.00" | | 490.63 Sq-in |
| Neck section: | 15.00" | 15.00" (1.25') | |

Applicant believes that these dimensions may be varied somewhat, as for example, by about 10 to about 15 percent, plus or minus, and that the figure will still provide good performance.

Certain dimensional relationships appear to be significant for good performance.

To achieve an extended range of bending movement, it is desirable that the combined cross section of the two leg sections be larger than the cross-section of the torso section. In this prototype the combined cross-section of the leg sections is about 900 square inches, while the torso cross-section is about 800 square inches.

This concept of progressively reducing the cross-section as you proceed upwardly along the figure must be balanced with the need to allow flexibility in the movement of the arm sections. In other words, too greatly reduced cross-section or constriction of the arm sections would limit their ability to flex and bend as desired. Nevertheless, in this prototype, good results were achieved with the combined cross-sections of air outlets of the head section and the two arm sections, being about 700 square inches versus the torso cross-section of about 800 square inches. If less movement is desired, the legs could be made shorter or other components could be varied.

With regard to relative lengths, in this prototype the leg and arm sections are each about twice the length of the torso section. This facilitated the desired flexing of arm and leg sections. At the same time, it is desirable that the proportioning of the figure still provide an esthetically pleasing appearance.

Air vent adjustments: In order to achieve proper balance in the alternating mode of dominating static and dynamic air pressure, the air vents can be adjusted for direction and air flow capacity. Based on the previously described dimensions of the dynamic figure the following results are being obtained:

In the head section: The single air vent at the top of the head section was about 16 inches in diameter. Reducing the diameter of that air vent destabilized the prototype model figure, with a resulting effect characterized by the leaning forward of the figure and lack of strength to straighten-up in full upright position. The opposite effect occurred when the top head air vent was made larger, resulting in lack of desired cyclical movement with the prototype model figure standing generally straight up, yet, prone to bending in the direction of blowing wind gusts.

In the arm sections: The angular direction, length, and air vent openings of the arm sections are important characteristics, which contribute to the overall performance of the dynamic figure:

Direction: Good performance angles of the longitudinal axis of each arm section, as measured from an upward extension of the vertical axis of the dynamic prototype figure, range between about 5 to about 30 degrees. The arm section orientation is symmetrical in all three axis. For angles of less than about 5 degrees, the figure tended to be pushed forcefully downwards when reaching upright position, with arm sections almost straight up. For angles exceeding about 30 degrees, the motion of the figure tended to often move sideways with little upward motion.

Length: In the present configuration, good performance, as well as esthetic look, is achieved with arm sections about 18 feet in length. Longer arm sections tend to slow down the motion, while shorter ones induce the opposite effect.

Air vent diameter: A vent diameter of the arm sections of about 18" seemed to maintain sufficient static pressure to maintain generally full volume of the torso and arm sections as well as sufficient dynamic pressure needed for desired movement.

In order to secure the leg sections of the figure to the air fans, various connecting means such as metal rings or velcro straps may be used. By way of example, in the working prototype, metal rings, each with a diameter of about 27 inches, were sewn into the lower end of each leg section. These enabled easy connection. Typically the figure was folded in an accordion fold, with the top up. The metal rings were pulled out and each one pulled over one of the air vents or baffles of one of the air fan units. The connections desirable provide general air tight fits between the fans and the figure.

Applicant's have also created a generally half size working prototype figure about 30 feet high, which provided good overall movement and stability. That figure had the following approximate dimensions:

| | Approximate Diameter (Inches) | Approximate Length (Inches) (Feet) | Approximate Cross Section (Square-inches) |
|---|---|---|---|
| Leg section: | 15.00" | 155.00" (13') | 353.25 Sq-in (Both) |
| Torso section: | 21.00" | 70.00" (5.75') | 346.19 Sq-in |
| Arm section (outlet) | 11.25" | 130.00" (10.75') | 198.70 Sq-in (Both) |
| Head section: | | 17.50" (1.50') | |
| Top (outlet): | 10.00" | | 78.50 Sq-in |
| Middle: | 15.70" | | 193.49 Sq-in |
| Neck section: | 10.00" | 10.00" (.75') | |

OPERATION OF THE PREFERRED EMBODIMENT

FIGS. 2 through 6A illustrate in sequential detail the initial inflation of the figure 40.

FIG. 2 shows the fully deflated figure 40 connected at the lower ends of its leg sections 42 to the pair of spaced apart fans 30. The fans 30 are off.

FIG. 3 illustrates the condition when the fans 30 begin to provide a generally constant input flow of air under pressure into the lower portions 42*a* of the leg sections 42. This flow is in an outward direction into the figure. The figure is beginning to extend in that outward direction. It will continue to extend in that outward direction until it reaches its extended position as described below. The apparatus 20 is illustrated with the outward direction being generally vertical or upright, as noted above. This orientation is desirable but not necessary in all cases.

Figure 4:
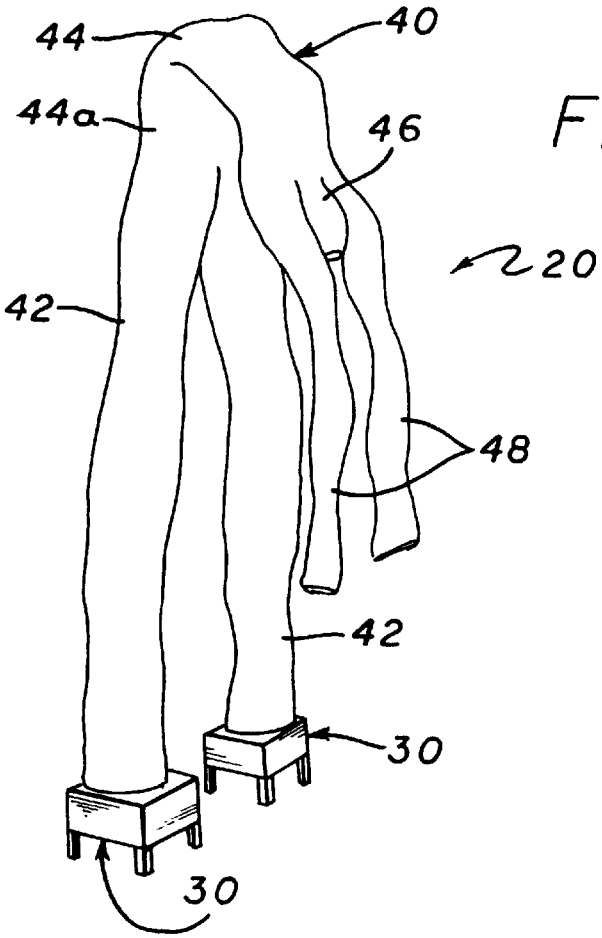

FIG. 4 shows continued inflation of the figure 40 where it is generally inflated up past the waist into the lower portion 44*a* of the torso section 44, but not yet into the upper portion of the torso section or into the head or arm sections 46, 48.

Figure 5:
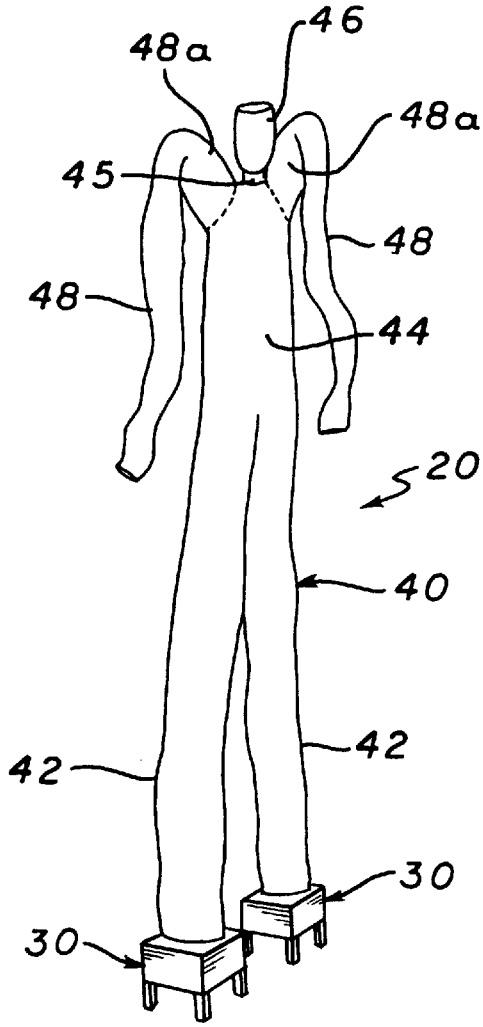

FIG. 5 shows yet further inflation of the figure 40 which has extended through leg sections 42 and the torso section 44, and into the head section 46 and the inward portions 48*a* of the arm sections 48.

FIG. 6A shows a schematic generally idealized inflation of the full figure 40 with all of the sections extending generally upwardly toward the sky, and just beginning to move.

FIGS. 6B through 6F show a sequential series of schematic views of the figure 40 as it goes through a representative series of cyclical movements typical of the operation of the preferred embodiment apparatus.

More particularly, in FIG. 6B, the figure 40 has begun to destabilize and collapse by virtue of gravity, the loss of internal static pressure from discharge of air through the outlets 46*b*, 48*b* in the head and arm sections 46, 48, the reactive forces from the air discharge through those outlets, and possible additional forces such as external wind, somewhat non-symmetrical distribution of the portions and thus the weight of the figure, etc. As shown in FIG. 6B, this has caused bending of the leg sections 42 outwardly as well as certain bending of the arm sections 48. Note the non-symmetrical bending of the arm and leg sections which adds a lifelike appearance to the motion of the figure 40.

In FIG. 6C the figure 40 has further destabilized and collapsed, and in particular has produced a deep knee bend and lowering of the torso section 44. This tends to block air flow through the figure and to build up primarily upwardly directed internal static pressure.

In FIG. 6D the primarily upwardly directed increased static pressure has pushed the figure 40 back up. This upward movement is also assisted by upward reactive forces produced by the outward generally downward flow of air from the outlets 48*b* at the ends of the downwardly extending arm sections 48. This downward flow is indicated by small arrows.

In FIG. 6E, the figure 40 is again generally fully inflated and at generally maximum height.

In FIG. 6F the figure 40 is again losing static pressure and starting to collapse to begin a new cycle.

The figure 40 thus oscillates or cycles between more upwardly extending positions and more destabilized collapsed, bent or contorted positions. As noted above, the arrangement of proportioning of the components of the figure could be modified to provide a smaller range of movement. It will be noted that movement of the figure is accomplished without imposing external control or constraint on the figure, or changing the generated airflow into the figure.

ALTERNATIVE CONSTRUCTIONS

FIG. 1B shows an alternative fan 130 with a barrel shaped housing 131.

FIG. 1C shows a fan 30 with a tall 4-blade spoiler 32.

Figure 1D:
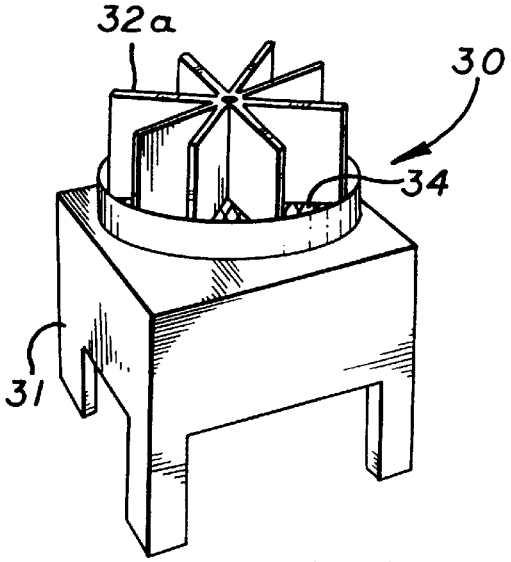
FIG. 1D is like FIG. 1C but with a short set of spoilers.

FIG. 1D shows a fan 30 with a short 8-blade spoiler 32*a*.

Figure 7:
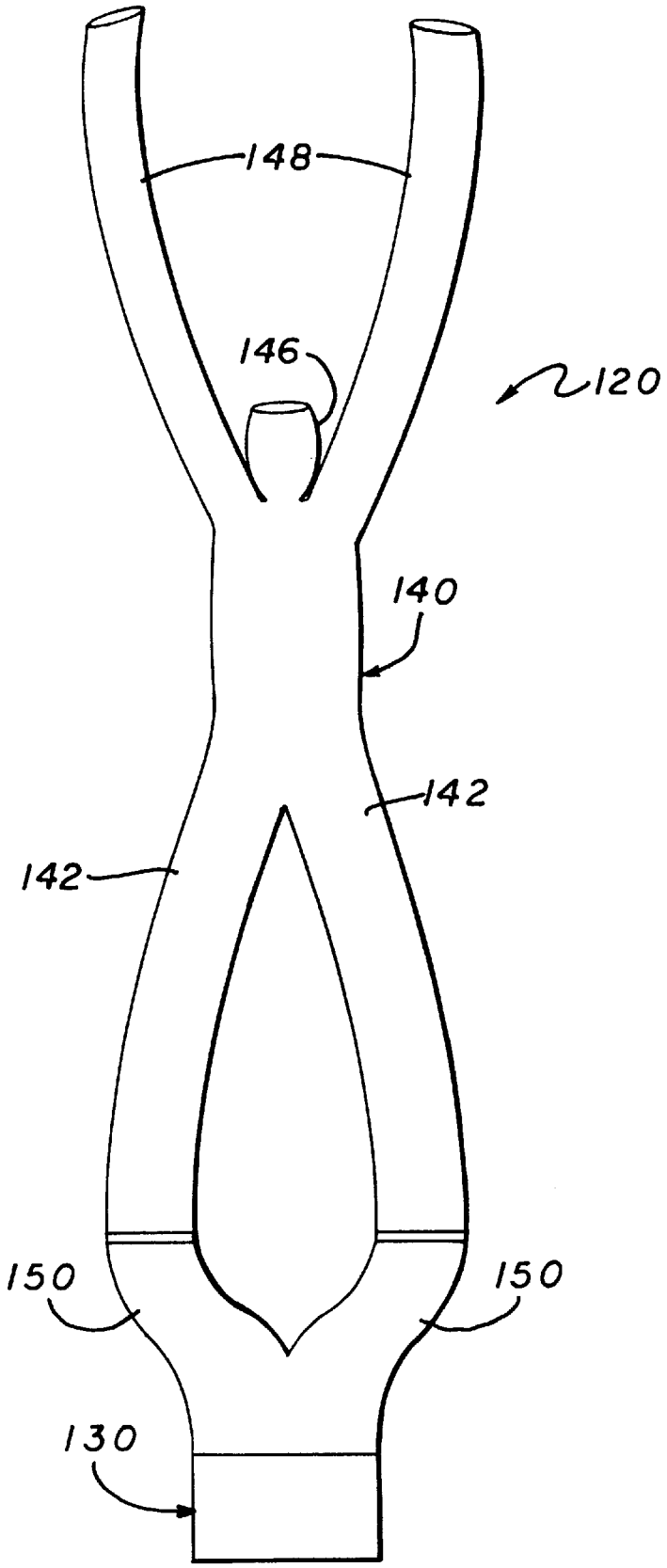
FIG. 7 is a schematic perspective view of a modified embodiment of the apparatus of the invention, having a single fan with a bifurcated output.

FIG. 7 illustrates an alternate construction 120 having a figure 140 wherein a single fan 130 has a bifurcated outflow leading to a pair of spaced-apart ports 150. Each of these ports 150 is connected to the lower end of one of the leg sections 142 of the figure 140.

FIG. 8 illustrates another alternative version of the apparatus 220 wherein the figure 240 has three spaced apart leg sections 242 and a bulbous or potato-like torso section 244. There are a large number (eleven in the illustrated figure 240) of ancillary or arm sections 248 that extend generally upwardly and outwardly from the torso section 244. Each ancillary section 248 has an outlet 248*b* at its outer end.

FIG. 9 illustrates another alternative form of apparatus 320 where the inflatable object 340 represents a non-figure such as a palm tree having a plurality of outwardly extending ancillary sections 348 which each represent a palm leaf or frond. Each ancillary section 348 has a vent or outlet 348*b* at its outer end. The main section 344 represents the upright trunk of the palm tree. Thus, this form of the apparatus illustrates a non-character form of object, and also illustrates a plurality of greater than two outwardly extending ancillary sections.

SUMMARY

Thus, the present invention features a new way to dynamically display inflatable objects, particularly figures. In the preferred form, the inflatable figure is designed to inflate quickly into a generally vertical position and subsequently generate movement within its own structure. Once fully inflated, the dynamic figure moves constantly in a random (or apparently random) and continuous mode. The figure's motion is produced by various factors, particularly by a combined build-up of, both, dynamic and static air pressures, which contribute to the shape as well as the movements of the figure. Such motion is in response to a continuous generally constant input of gas into the figure and without intentional intervention.

Various modifications and changes may be made in the illustrated structures without departing from the spirit and scope of the present invention as set forth in the following claims.

What is claimed is:

1. Apparatus for providing a gas suspended bendable object that, in response to a continuous generally constant flow of gas in an outward direction into the object and without intentional intervention, inflates to a generally outwardly extended position and then automatically and continuously performs a generally repetitive cycle of movements between the extended position and at least one bent position, and between the at least one bent position and another bent position, said apparatus comprising:

a) a gas delivery means for providing a continuous generally constant flow of gas, and b) an erectable bendable hollow object comprised at least primarily of flexible sheet material, said object being connected to and in fluid communication with the gas delivery means to receive gas flow generally in the outward direction, said object having a hollow main section that has a generally central axis, said main section extending generally in the outward direction to an outwardly extended position by the flow of gas from the gas delivery means, said object also having at least one hollow ancillary section that is attached to and in fluid communication with the main section, said ancillary section extending away from the main section when filled with the gas, said object including at least two spaced apart gas outlets spaced remotely from the gas delivery means for release of the gas from within the object, said outlets being proportioned so that generally all of the gas being continuously provided to said object is continuously released from said object through said outlets without restriction by said outlets, said gas delivery means, said object and said outlets being constructed, proportioned and arranged so that, without significant change in said gas flow from said delivery means and without intentional intervention, the object automatically responds by initially inflating and erecting to the generally outwardly extended position due to gas flow and build-up of static pressure, then destabilizing and moving to a bent position due to relative decrease in static pressure caused by release of gas through said outlets, the bent position resulting from at least one bend in at least one of the main and the ancillary sections, each of said at least one bend creating at least a temporary partial restriction to gas flow thereby causing another build-up of the static pressure within the at least one of the respective sections and continuing to generally repeat this cycle of movements.

2. The apparatus of claim 1 wherein there are at least two of said ancillary sections.

3. The apparatus of claim 1 wherein the flow released from said outlets is generally symmetrical with respect to said axis.

4. The apparatus of claim 1 wherein at least one of said outlets is located on said ancillary section.

5. The apparatus of claim 4 wherein said ancillary section, when said main and ancillary sections are in their extended positions, extends in a direction generally parallel to said axis, and one of said outlets is located at an outward portion of said ancillary section.

6. The apparatus of claim 2 wherein the main section includes subsections that represent a torso and a head of a figure, the main section having an outward end and the head being at said outward end, the ancillary sections each representing an arm of the figure.

7. The apparatus of claim 6 wherein the portion of the main section opposite the head is bifurcated to form a separate pair of subsections each representing one leg of the figure.

8. The apparatus of claim 7 wherein the arm sections and the leg sections are each about twice the length of the torso section.

9. The apparatus of claim 6 wherein the head and arm sections each have one of said outlets, and the cross-section of the torso section is equal to or larger than the combined cross section of said outlets from the head and arm sections.

10. The apparatus of claim 1 wherein the main section has an inner portion which is bifurcated to provide, when the main section is inflated, a pair of spaced apart inward subsections.

11. The apparatus of claim 10 wherein each of said inward subsections has an inward portion and the gas delivery means comprises a pair of spaced apart fans each connected to and in fluid communication with the inward portion of one of said inward subsections.

12. The apparatus of claim 10 wherein the gas delivery means comprises a single fan having a bifurcated output to a pair of spaced apart ports, each port being connected to and in fluid communication with the inward portion of one of said inward subsections.

13. The apparatus of claim 1 wherein the gas delivery means is adjustable to provide selectively different levels of generally constant flow to accommodate different conditions.

14. The apparatus of claim 1 wherein the flexible sheet material of the object is generally thin, light-weight and non-expandable.

15. The apparatus of claim 1 wherein the flexible sheet material of the object is generally non-porous.

16. The apparatus of claim 1 wherein said outward direction is generally vertical.

17. Apparatus for providing gas suspended bendable object that, in response to a continuous generally constant input flow of gas in an outward direction into the object and without intentional intervention, erects to a generally extended position and then automatically and continuously performs a generally repetitive cycle of movements between the extended position and at least one bent position, and between the at least one bent position and another bent position, said apparatus comprising:

a) gas delivery means for providing a generally continuous flow of gas, and b) an erectable bendable hollow object comprised at least primarily of flexible sheet material, said object being connected to and in fluid communication with the gas delivery means to receive gas flow generally in the outward direction, said object having a hollow main outer section that has a generally central axis and inward and outward portions, said main section extending generally in the outward direction to the outwardly extended position by the flow of gas from the gas delivery means, said object also having a pair of hollow ancillary inner sections that each have inward and outward portions, each of said inner sections being attached at its outward portion to and in fluid communication with the inward portion of the main section, each of said inner sections also being attached at its inward portion to and in fluid communication with said gas delivery means, said object including at least one gas outlet spaced remotely from the gas delivery means for release of the gas from within the object, said at least one gas outlet being proportioned so that generally all of the gas being provided to said object is continuously released from said object through said at least one gas outlet substantially without restriction by said at least one gas outlet, said gas delivery means, said object and said at least one gas outlet being constructed, proportioned and arranged so that, without significant change in said gas flow from said delivery means and without intentional intervention, the object automatically responds by initially inflating and erecting to the generally outwardly extended position due to the gas flow and build-up of static pressure, then destabilizing and moving to a bent position due to relative decrease in static pressure caused by release of gas through said at least one outlet, the bent position resulting from at least one bend in at least one of the main and the ancillary inner sections, each of said at least one bend creating at least a temporary partial restriction to gas flow thereby causing another build-up of the static pressure within the at least one of the respective sections and returning the object to one of the generally outwardly extended position and other bent positions, and continuing to repeat this general cycle of movements.

18. Apparatus for providing a gas suspended multi-limb figure that, in response to a continuous generally constant flow of gas and without intentional intervention, erects to a generally upwardly extended position and then automatically and continuously performs a generally repetitive cycle of movements, said apparatus comprising:

a) a gas delivery means for providing a continuous generally constant upward flow of gas, and b) an erectable bendable hollow object defining the multi-limb figure and comprised at least primarily of flexible sheet material, said object having a hollow main section and at least two hollow ancillary sections attached to the main section as limbs and in fluid communication with the main section, the object being initially collapsed and having upper and lower end portions when erected, the lower end portion being connected to and in fluid communication with the gas delivery means to receive gas flow in a generally upward direction of flow, said object including at least two spaced apart gas outlets in the upper end portion thereof for release of the gas from within the object, said outlets being proportioned so that generally all of the gas being continuously provided to said object is continuously released from said object through said outlets substantially without restriction by said outlets, said gas delivery means, said object and said outlets being constructed, proportioned and arranged so that, without significant change in said gas flow from said delivery means and without other intentional intervention, the object automatically responds by initially inflating and erecting to the generally upwardly extended position due to gas flow and build-up of static pressure, then destabilizing and moving to a bent position due to relative decrease in static pressure caused by release of gas through said outlets, the bent position resulting from at least on bend in at least one of the main and ancillary sections, the at least one bend creating a temporary partial restriction to gas flow, thereby causing another build-up of the static pressure within the object and returning the object toward the generally upwardly extended position, and continuing to repeat a general cycle of movements between the generally upwardly extended position and the bent position, and between the bent position and other bent positions.

19. The apparatus of claim 18 wherein the main section represents a torso of a figure, and including ancillary sections respectively representing a head and at least one arm of the figure at the upper end portion of the object.

20. The apparatus of claim 19 including a pair of bifurcated ancillary sections at the lower end portion of the object, each representing one leg of the figure.

21. The apparatus of claim 20 wherein the arm sections and the leg sections are each about twice the length of the torso section.

22. The apparatus of claim 19 wherein the head and arm sections each have one of said outlets, and the cross-section of the torso section is within the range of slightly greater to slightly larger than the combined cross section of said outlets from the head and arm sections.

23. The apparatus of claim 20 wherein the gas delivery means comprises a pair of spaced apart fans each connected to and in fluid communication with one of said pair of bifurcated ancillary sections.

24. The apparatus of claim 20 wherein the gas delivery means comprises a single fan having a bifurcated output to a pair of spaced apart ports, each port being connected to and in fluid communication with one of said pair of bifurcated ancillary sections.

25. The apparatus of claim 18 wherein the gas delivery means is adjustable to provide selectively different levels of generally constant flow to accommodate different conditions.

26. The apparatus of claim 18 wherein the flexible sheet material of the object is generally thin, light-weight and non-expandable.

27. The apparatus of claim 18 wherein the flexible sheet material of the object is generally non-porous.

28. A method for displaying a multi-limb figure formed by a gas suspended bendable object comprised primarily of flexible sheet material having a hollow main section and at least two hollow ancillary sections attached to the main section as limbs and in fluid communication with the main section, the object being initially collapsed and having upper and lower end portions when erected, said method comprising the steps of:

a) supplying a generally constant flow of gas to the lower end portion of the collapsed object to initially inflate the object by pressure developed by the flow of gas to a generally erect position in which the ancillary sections extend as the limbs from the main section;

b) discharging substantially the entire flow of gas from the upper end portion of the object while maintaining supply of the generally constant flow so that the object is retained in the erect position primarily by dynamic pressure of the gas flow through the object, but under a reduced static pressure, thereby causing at least one of the main and ancillary sections to fall about at least one bend in a region of the object and creating at least a partial temporary restriction to the flow of gas;

c) continuing to supply the generally constant flow of gas to the lower end portion of the object to increase static pressure in the region containing the at least one bend until the object is re-erected at least in that region; and d) repeating steps b) and c) without intentional intervention to automatically and continuously perform a generally repetitive cycle of object movements between the erect position and a bent position, and between the bent position and other bent positions.

29. The method of claim 28 wherein substantially the entire flow of gas is discharged from the main section and at least one of the at least two the ancillary sections.

30. The method of claim 28 wherein the flow of the gas into the object is selectively changeable to different generally constant rates to accommodate different conditions.

31. The apparatus of any one of claims 2 or 18 wherein at least one of said outlets is located on each of said ancillary sections.

32. The apparatus of claim 6 wherein said ancillary sections, when said object is in the extended position, extend in directions generally parallel to said axis, and one of said outlets is located at an outward portion of each ancillary section.

33. The apparatus of claim 31 wherein the combined cross-section of said outlets approximates the cross-section of the main section when the object is erected.

* * * * *